United States Patent [19]

Jorgensen et al.

[11] Patent Number: 4,611,443

[45] Date of Patent: Sep. 16, 1986

[54] WALL LINE INSULATION PILLOWS

[76] Inventors: Ralph H. Jorgensen, Box 7, Site 9, R.R. #6, Calgary, Alberta, Canada, T2M 4L5; Patrick J. Windle, 18 Wakefield Drive S.W., Calgary, Alberta, Canada, T3C-2W7

[21] Appl. No.: 570,323

[22] Filed: Jan. 13, 1984

[51] Int. Cl.[4] ..... E04B 7/02

[52] U.S. Cl. ..... 52/95; 52/199; 98/37

[58] Field of Search ..... 52/404–407, 52/809, 202, 94, 199, 198, 92, 95; 98/37

[56] References Cited

U.S. PATENT DOCUMENTS

| | | | |
|---|---|---|---|
| 1,761,838 | 6/1930 | Mowery | 52/407 |
| 1,921,518 | 8/1933 | Frobisher | 52/407 |
| 3,972,164 | 8/1976 | Grange | 52/95 |
| 4,265,060 | 5/1981 | Woodhams | 52/95 |
| 4,265,067 | 5/1981 | Palmer | 52/809 |
| 4,269,007 | 5/1981 | Ward | 52/95 |

*Primary Examiner*—John E. Murtagh

*Attorney, Agent, or Firm*—Jacobson and Johnson

[57] ABSTRACT

A block of insulating material which increases in thickness from one end to a maximum at the other end is used to fill the wedge-shaped recess between adjacent rafters and the junction between the vertical wall and the rafters. In one embodiment it is placed on the flat upper side of the ceiling panel between adjacent ceiling joists and in another embodiment it is reversed and engaged against the sloping roof panel between adjacent roof rafters. In both embodiments, the insulation is blown against the curved surface and the increase in thickness of the pillow maintains a relatively constant R value to the outer surface of the wall.

1 Claim, 10 Drawing Figures

WALL LINE INSULATION PILLOWS

BACKGROUND OF THE INVENTION

This invention relates to new and useful improvements in insulating pillows for insulating the wall line area or junction between a vertical wall and the sloping roof. Adjacent roof rafters and ceiling joists, where they rest upon the upper plate of a vertical wall, forms a wedge-shaped recess beyond which is usually provided a soffit area.

It is normal to insulate an attic area by the use of blown or loose fill insulation supported by the ceiling panels attached to the underside of the ceiling joists and in order to get the necessary R value, a considerable thickness of such insulation is required.

While this is no problem over the major area of the attic floor, nevertheless as the wedge-shaped recesses are reached, the thickness of the insulation necessarily decreases thereby causing a situation where the R value also decreases from the desired amount.

When using loose fill insulation, it is also necessary firstly to prevent same from being blown or displaced into the soffit area and perhaps blocking the air intake thereof and also to provide an air passageway from the soffit area to the free air area above the insulation within the attic area.

SUMMARY OF THE INVENTION

The present device solves all of these problems by providing a wedge-shaped pillow formed of an insulation material having a relatively high R value so that the R value of the insulation is maintained to the outer surface of the vertical wall. Means also may be incorporated which maintains an open air passageway between the soffit area and the free air area above the insulation so that the necessary circulation of air may take place thus preventing condensation occurring.

Vent and baffle units are well known and examples include U.S. Pat. No. 4,214,510 which shows a vent and baffle unit made from a single thickness of material. U.S. Pat. No. 4,223,489 shows an insulation stop which once again merely prevents insulation from passing into the soffit area but does not add to the insulating value of the structure.

U.S. Pat. No. 4,237,672 shows a roofing vent with an installation tool and U.S. Pat. No. 4,184,416 shows a combination of thermal insulation stop and ventilation baffle. U.S. Pat No. 4,185,433 shows an insulation baffle and U.S. Pat. No. 3,863,553 shows a combination insulation stop and ventilating baffle.

However, none of these are formed from an insulating material per se which not only acts as an insulating stop and baffle but also maintains the necessary insulating value to the outer surface of the vertical wall.

In accordance with the invention there is provided a wall line insulating pillow locatable within the wedge-shaped recess defined by adjacent roof rafters, roof panels extending therebetween and adjacent ceiling joists and ceiling panels therebetween, said pillow maintaining the insulation R value between attic insulation and the outer surface of the structural wall; comprising in combination a substantially wedge-shaped block of insulating material having a substantially rectangular face, a substantially rectangular wall extending upwardly from one edge of said face, spaced and parallel side walls extending upwardly from said face and a further face extending from the distal edge of said wall to the other edge of said face with the thickness and hence the R value of said pillow increasing from said other edge of said face towards said substantially rectangular wall.

In accordance with another aspect of the invention there is provided a wall line insulation pillow for location within the wedge-shaped recess defined by adjacent roof rafters, roof panels extending therebetween and adjacent ceiling joists with ceiling panels therebetween, comprising in combination a wedge-shaped block of insulating material engageable within the associated wedge-shaped recess whereupon the R value of said pillow increases from the thinner end of said wedge towards the thicker end thereof and means to maintain said pillow in position within said recess.

A yet further advantage of the invention is to provide a device of the character herewithin described which is simple in construction, economical in manufacture and otherwise well suited to the purpose for which it is designed.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
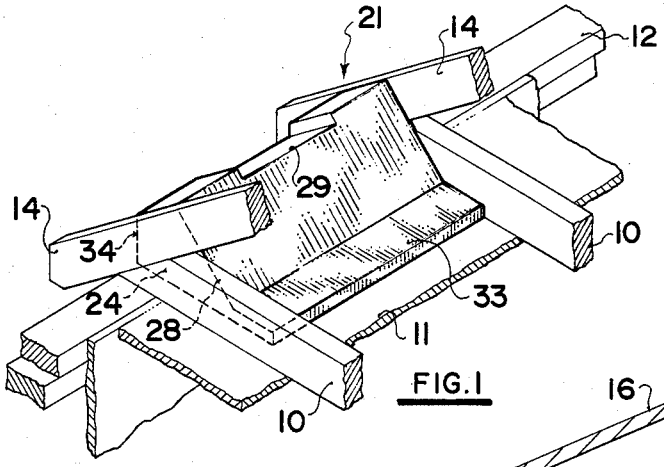
FIG. 1 is an isometric view of the device situated between adjacent ceiling joists.
Figure 2:
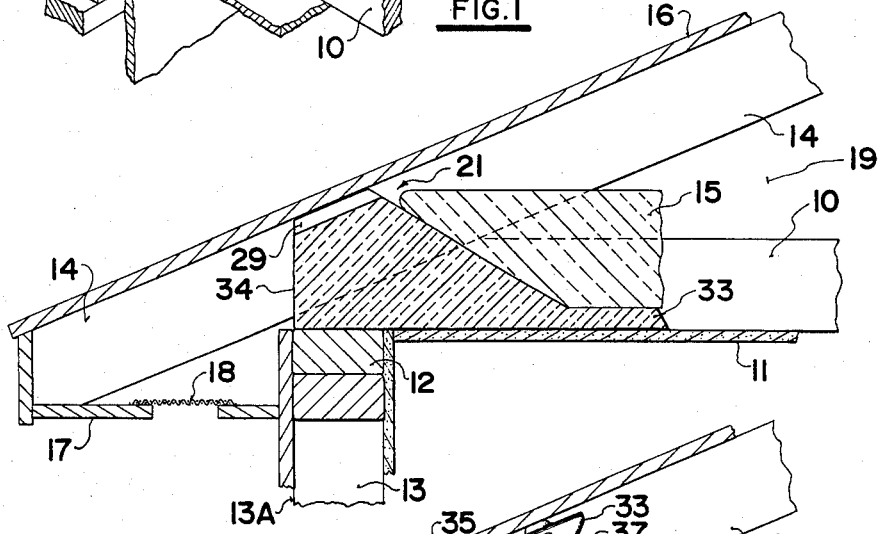
FIG. 2 is a cross sectional view of FIG. 1 extended to show the soffit area.

Proceeding therefore to describe the invention in detail, reference should first be made to FIGS. 1 and 2 in which reference character 10 shows spaced and parallel ceiling joists having a ceiling panel 11 secured to the underside thereof in the usual way. Said panel may be of a dry wall construction, plywood, or any other well known material.

These ceiling joists rest upon the upper horizontal plate 12 of a vertical wall shown schematically at 13 and spaced and parallel roof rafters 14 also rest upon the plates 12 one adjacent each ceiling joist 10. Conventionally, the roof rafters incline upwardly and inwardly from the upper side of the vertical wall 13 thus defining a wedge-shaped area 15 between adjacent joists 10, adjacent rafters 14, the ceiling panel 11 and a corresponding roof panel 16 spanning the upper sides of the roof rafters. The roof rafters normally extend outwardly beyond the outer side 13A of the vertical wall with a soffit panel 17 extending inwardly from the extremities of the rafters to the outer surface in a conventional manner. Such soffit areas or panels 17 normally include ventilators 18 at spaced intervals to permit air circulation through the attic area indicated by reference character 19.

In climates requiring the upper side of the ceiling panels 11 to be insulated, it is conventional to utilize a standard loose fill insulation indicated by reference character 20 and this insulation may take the form of fiber, loose rock, wool or the like. It is either poured or blown into position between adjacent joists 10 to a sufficient thickness above the joists to give the necessary insulating R value.

No problem is encountered in placing a sufficient thickness of insulation over the majority of the attic floor but as the wedge-shaped areas are encountered, it is obvious that the thickness of the insulation must decrease to practically nil adjacent the outer surface 13A of the outer wall 13. This necessarily decreases the R value below the desired figure. Furthermore when such insulation is blown into position, it often extends between adjacent roof rafters and into the soffit area and may even block the air intakes 18 thus preventing the desired circulation of air.

The pillow collectively designated 21 is placed in the wedge-shaped area 15 and acts firstly to maintain the necessary insulation value to adjacent the outer surface 13A of the wall 13 and secondly acts as an insulating stop thus preventing loose insulation from entering the soffit area. At the same time the desired air circulation is maintained between the soffit area and the attic area 19.

Several embodiments are shown but they all incorporate a substantially wedge-shaped block of insulating material having a relatively high R value. A preferred material to use is polyurethane but other rigid foam insulation materials may be used depending upon design parameters and the desired R value required. It will also be appreciated that any other insulating material may be used instead of foam, depending once again on design parameters.

It consists of a substantially rectangular face 22 having a substantially rectangular wall 23 extending upwardly therefrom. Spaced and parallel end walls 24 are provided with another face 25 which curves over and then downwardly towards a junction line 26 with the first mentioned rectangular face 22. The configuration of the face 25 may curved inwardly as at 27 or may be relatively straight as at 28 (see FIG. 1).

Figure 8:
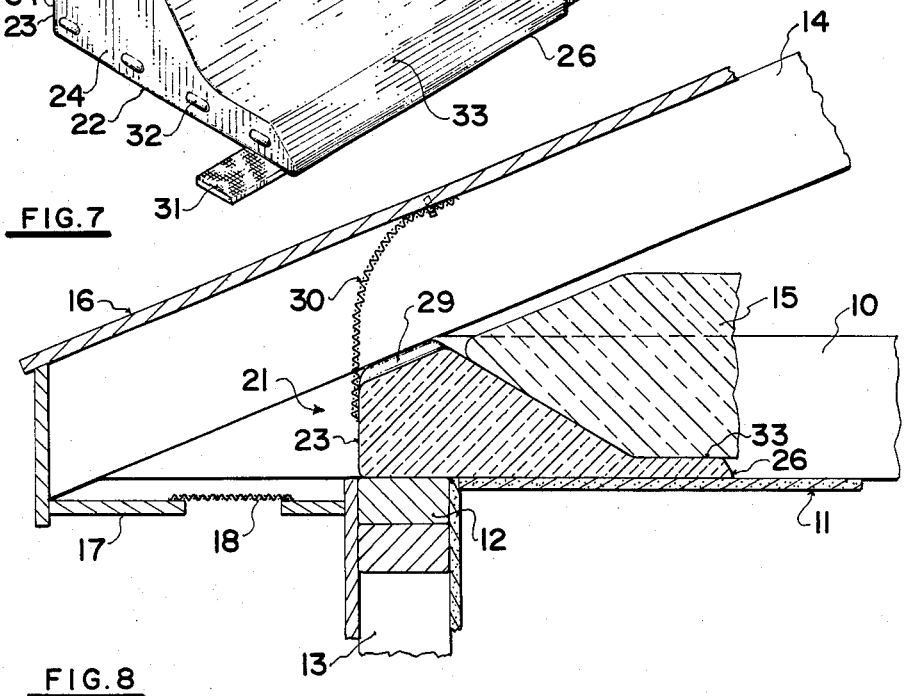
FIG. 8 is a view similar to FIG. 2 but utilizing the embodiment of FIG. 7.

In the embodiment illustrated in FIGS. 1, 2 and 8, the insulating pillow is situated between adjacent ceiling joists 10, the width of the pillow being such that it is a relatively snug fit therebetween as clearly shown in FIG. 1.

Thus the rectangular face 22 becomes the base and it is moved outwardly towards the outer surface 13A of the wall until it takes up the position shown in FIGS. 1 and 8.

Depending upon the height of the rear side or thicker side of the wedge-shaped pillow, it may be necessary to provide an air vent slot 29 on the the upper side of the thicker end of the wedge and between the end walls 24, it being assumed that the device is in the position shown in FIGS. 1 and 8. It is also desirable to provide a rectangular panel 30 of screen material such as netting or the like secured by the lower edge thereof to adjacent the upper side of the rectangular rear wall 23 as by stapling or adhesive. This flexible panel curves upwardly and inwardly when the pillow is installed as shown in FIG. 8, and may be stapled or otherwise secured to the inner surface of the roof panel 16. This allows the desired air circulation to be maintained but prevents the loose insulation 20 from passing outwardly into the soffit area. Once the pillows are installed, the insulation may be blown or poured in position.

Figure 7:
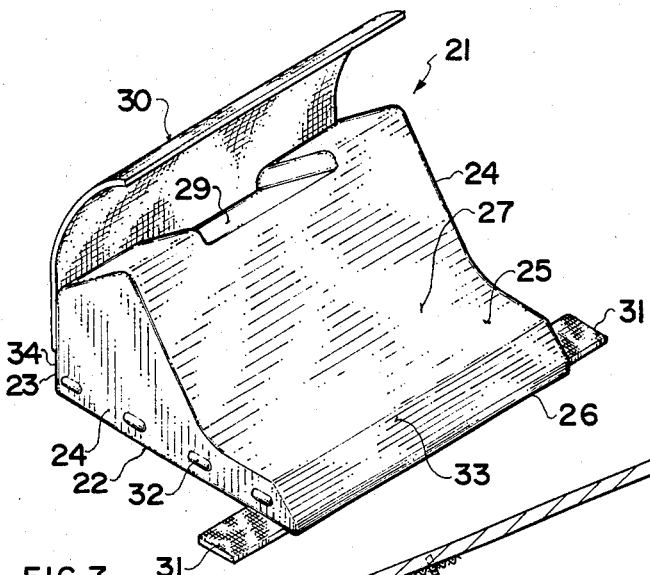
FIG. 7 is an isometric view of one embodiment of the insulating pillow.

Means are provided to maintain the pillows in the desired location and FIG. 7 shows one embodiment comprising small tabs 31 extending outwardly from the pillow upon the rectangular face 22 thereof. These may be stapled or otherwise secured to the ceiling joists 10 once it has been placed in position.

Alternatively, a plurality of small interference-fit protrusions 32 may be formed when the pillow is manufactured, extending from each end wall 24 so that when the pillow is engaged between the adjacent ceiling joists 10, these partially collapse and hold the pillow in position by friction.

FIGS. 3 through 6 show the device used in the preferred environment under which circumstances, it is reversed with respect to FIGS. 1, 2, 7 and 8 and secured between adjacent roof joists 14. Once again the increase in thickness between the inner or relatively thin end 33 and the outer or thicker end 34, maintains the necessary R value to adjacent the outer surface 13A of the vertical wall. The air vent slots are provided, in this embodiment, by the provision of a plurality of spaced apart protrusions 35 extending from the rectangular face 22 and engaging against the inner surface of the roof panel 16 thus permitting a flow of air to take place between the soffit area and the attic area above the insulation 20.

It may be held in position by means of the aforementioned tabs 31 or by the interference-fit protrusions 32 which engage against the inner surfaces of the adjacent roof rafters between which the pillow is situated.

Figure 4:
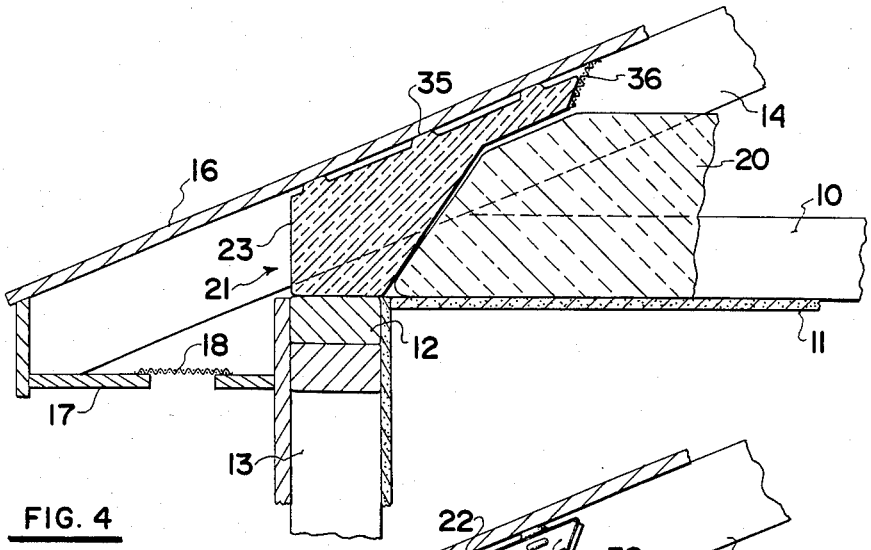
FIG. 4 is a cross sectional view of FIG. 3.
Figure 5:
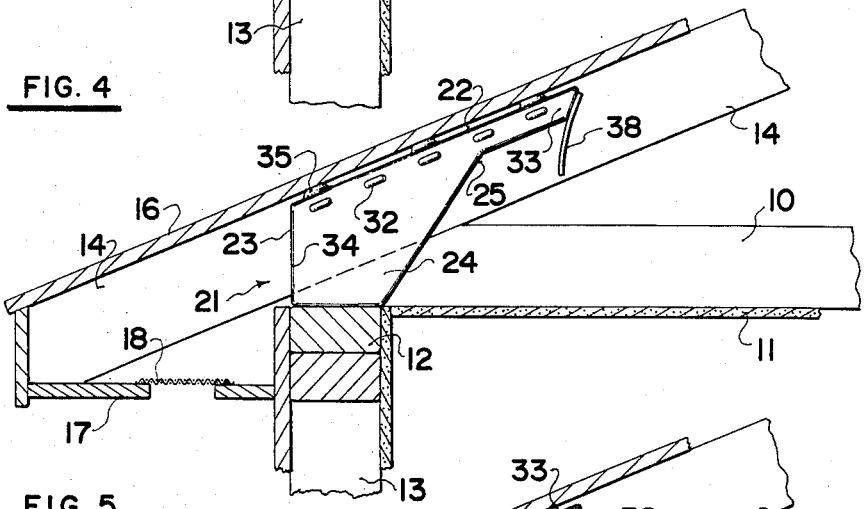
FIG. 5 is a view similar to FIG. 3 but showing the flexible membrane secured to the leading edge.

A relatively small rectangular panel of screening material 36 may be secured to the thin end or junction 26 between the two faces and may extend upwardly to the inner surface of the roof panel as shown in FIG. 4 and may be secured thereto in order to prevent loose fill insulation from passing downwardly into the soffit area.

Figure 3:
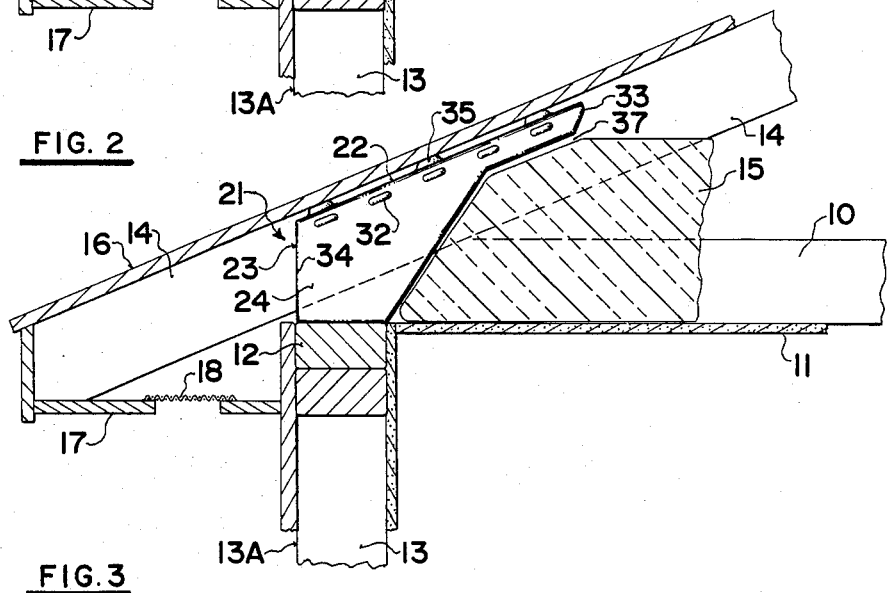
FIG. 3 is a side elevation of the device shown in position against the roof panel.
Figure 6:
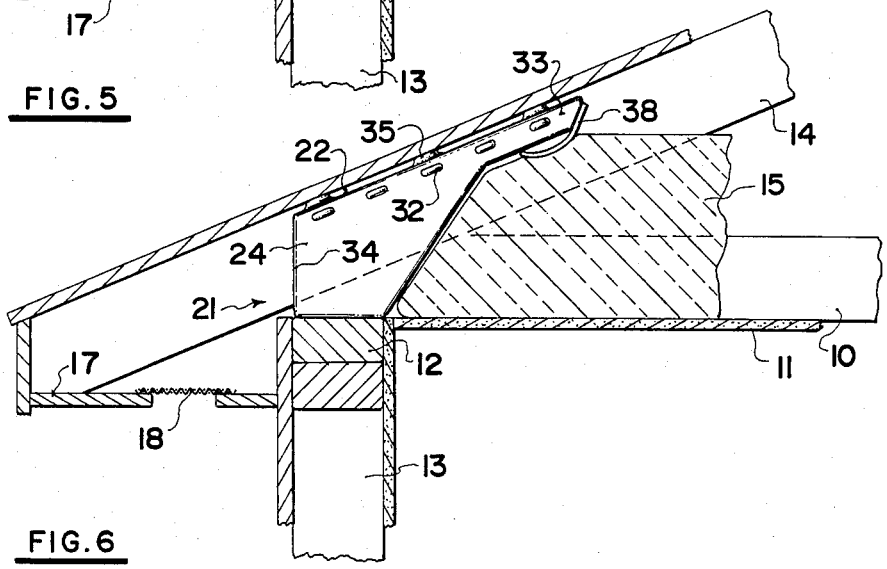
FIG. 6 is a view similar to FIG. 5 but showing the flexible membrane in conjunction with the blown loose fill insulation.

One of the faults of loose or blown in insulation is that it tends to settle with time thereby developing an air gap illustrated by reference character 37 in FIGS. 3 and 6. In order to close this air gap, a strip of flexible material in the form of a flexible membrane 38 is secured across the thinner end 33 and hangs downwardly as clearly shown in FIG. 5. When the insulation is blown or otherwise installed, the membrane bends upwardly or flexes upwardly as shown in FIG. 6 and as the air gap 37 develops, this membrane maintains contact with the upper surface of the insulation. If this gap is not closed, the R values will not be additive between the insulation 20 and the pillow 21. As it settles, so will the floating membrane so that the developing air gap thus remains enclosed.

It will be appreciated that the insulating pillow 21 may, if desired, be surrounded with or by reflective foil which enhances the total R value considerably.

Figure 9:
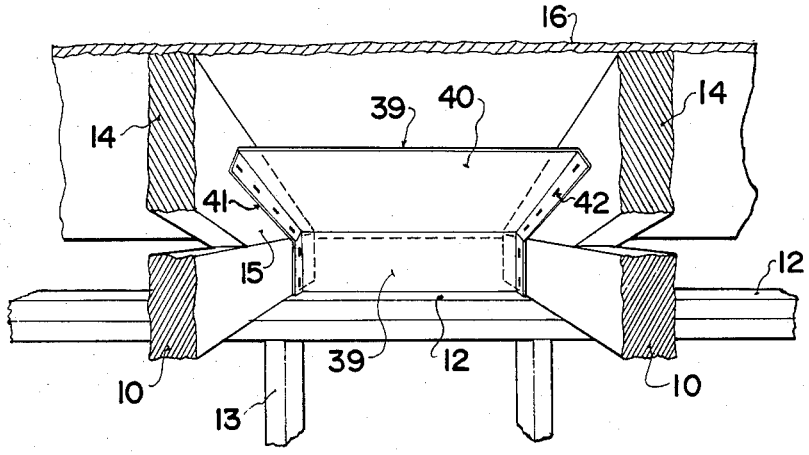
FIG. 9 is a fragmentary isometric view of an alternative method of construction.
Figure 10:
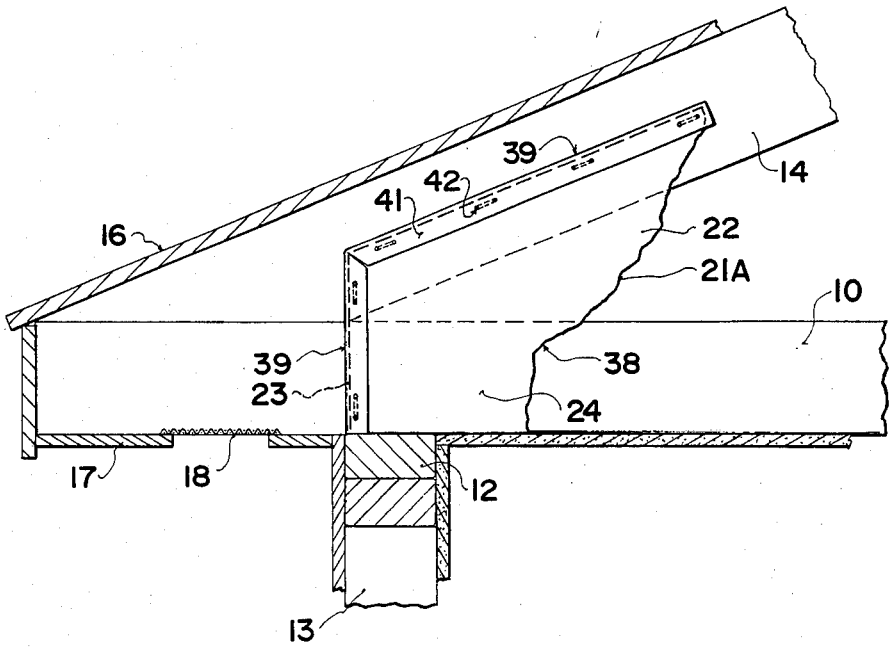
FIG. 10 is a side section view of FIG. 9.

FIG. 9 shows an alternative method of constructing the pillow which consists of foaming in place a pillow 21A within the area 18 and in the form of a wedge-shaped configuration similar to the pillow 21 except that the configuration is similar to that shown in FIG. 10. It includes the substantially rectangular face 22, the end walls 24, the substantially rectangular rear wall 23 and a rough surfaced upwardly and inwardly sloping face wall 38. A back stop panel 39 is first secured between the adjacent ceiling joists 10 and an inverted channel panel 39 is provided between adjacent ceiling joists portion 40 with side panels 41 which in turn are secured to the inner faces of adjacent ceiling joists 14 by staples 42 or the like. This channel is spaced downwardly from the underside of the roof panel 16 and, when the foam is in place, provides the necessary air space between the pillow and roof panel, communicating with the soffit area.

Since various modifications can be made in my invention as hereinabove described, and many apparently widely different embodiments of same made with the spirit and scope of the claims without departing from such spirit and scope, it is intended that all matter contained in the accompanying specification shall be interpreted as illustrative only and not in a limiting sense.

We claim:

1. A wall line insulation pillow locatable with a wedge-shaped recess defined by adjacent roof rafters, roof panels extending therebetween and adjacent ceiling joists and ceiling panels therebetween, said pillow maintaining the insulation R value between attic insulation and the outer surface of a structural wall, comprising in combination a substantially wedge-shaped block of insulating material having a first planar substantially rectangular face, a substantially rectangular wall extending upwardly from one edge of said first face to distal edge of said rectangular wall, spaced and parallel side walls extending upwardly from said first face and a second face extending from said distal edge of said rectangular wall to a junction at an edge of said first face opposed to said one edge thereof with the thickness and hence the R value of said pillow increasing from said opposed edge of said first face towards said one edge thereof at said rectangular wall, said pillow, when in situ being situated with said first face forming the base thereof and engaging said ceiling panels between adjacent ceiling joists and air vent means being formed through said second face from the front to the rear thereof, said rectangular wall joining contiguously with said first planar face at a corner whereby said pillow can be slid into place in said wedge-shaped recess with said first face in contact with said ceiling panel until said second face engages said roof panel, and a flexible membrane secured by one edge thereof to the junction between said first and second faces and depending downwardly therefrom when said pillow is in situ between adjacent roof rafters.

* * * * *